US009719522B2

(12) United States Patent
Yamamoto

(10) Patent No.: US 9,719,522 B2
(45) Date of Patent: Aug. 1, 2017

(54) WATER PUMP

(75) Inventor: Junya Yamamoto, Toyota (JP)

(73) Assignee: AISIN SEIKI KABUSHIKI KAISHA, Kariya, Aichi (JP)

( * ) Notice: Subject to any disclaimer, the term of this patent is extended or adjusted under 35 U.S.C. 154(b) by 649 days.

(21) Appl. No.: 14/237,197

(22) PCT Filed: Aug. 1, 2012

(86) PCT No.: PCT/JP2012/069576
§ 371 (c)(1),
(2), (4) Date: Feb. 5, 2014

(87) PCT Pub. No.: WO2013/038828
PCT Pub. Date: Mar. 21, 2013

(65) Prior Publication Data

US 2014/0169942 A1 Jun. 19, 2014

(30) Foreign Application Priority Data

Sep. 12, 2011 (JP) ..... 2011-198680

(51) Int. Cl.
*F04D 29/12* (2006.01)
*F04D 29/10* (2006.01)
*F04D 13/02* (2006.01)

(52) U.S. Cl.
CPC ..... *F04D 29/128* (2013.01); *F04D 13/02* (2013.01); *F04D 29/106* (2013.01); *F05B 2260/603* (2013.01)

(58) Field of Classification Search
CPC ..... F04D 29/128; F04D 13/02; F04D 29/106; F05B 2260/603
See application file for complete search history.

(56) References Cited

U.S. PATENT DOCUMENTS 5,338,153 A 8/1994 Swanson et al.
2002/0136633 A1 9/2002 Ozawa et al.

FOREIGN PATENT DOCUMENTS

JP 2-90399 U 7/1990
JP 6-23760 Y2 6/1994
JP 2000146233 A 5/2000
(Continued)

OTHER PUBLICATIONS

Office Action (Notice of Reasons for Rejection) issued on May 10, 2016, by the Japanese Patent Office in corresponding Japanese Patent Application No. 2013-533566 and an English translation of the Office Action. (5 pgs).
(Continued)

*Primary Examiner* — John C Hong
(74) *Attorney, Agent, or Firm* — Buchanan Ingersoll & Rooney PC

(57) ABSTRACT

A water pump that minimizes defects in which cooling water flows externally is provided. The water pump is provided with a rotating shaft supported by a body via a bearing, an impeller that is disposed at one end of the rotating shaft, and a seal member that is disposed between the impeller and the bearing. A drain passage that sandwiches the seal member and communicates with a space formed on the opposite side of the impeller is formed in the body, and a reservoir is formed downstream from the drain passage. At an upper position of a wall portion that forms the reservoir, a drain hole is formed, and a water-absorbing planar member is positioned in the reservoir.

6 Claims, 4 Drawing Sheets

(56) References Cited

FOREIGN PATENT DOCUMENTS

| | | | |
|---|---|---|---|
| JP | 2002-122100 | A | 4/2002 |
| JP | 2003042488 | A | 2/2003 |
| JP | 2003-328992 | A | 11/2003 |
| JP | 2008-169763 | A | 7/2008 |
| JP | 2009-228528 | A | 10/2009 |

OTHER PUBLICATIONS

The extended European Search Report issued on Mar. 16, 2016, by the European Patent Office in corresponding European Patent Application No. 12831956.3-1608 (7 pgs).

International Search Report (PCT/ISA/210) mailed on Oct. 16, 2012, by the Japanese Patent Office as the International Searching Authority for International Application No. PCT/JP2012/069576.

Written Opinion (PCT/ISA/237) mailed on Oct. 16, 2012, by the Japanese Patent Office as the International Searching Authority for International Application No. PCT/JP2012/069576.

Notification of Transmittal of Translation of the International Preliminary Report on Patentability (Form PCT/IB/338 and PCT/IB/373) and the Written Opinion of the International Searching Authority (Form PCT/ISA/237) issued on Mar. 12, 2014, by the International Bureau of WIPO for International Application No. PCT/JP2012/069576. (6 pages).

WATER PUMP

TECHNICAL FIELD

The present invention relates to a water pump useful for cooling an internal combustion engine (engine) used in an automobile, etc.

BACKGROUND ART

In a water pump used for cooling an internal combustion engine (engine), a rotating shaft is supported to a body via a bearing. A drive pulley is fixed to one end of the rotating shaft and an impeller is fixedly attached to the other end of the same. Between the impeller and the bearing, a mechanical seal is disposed for preventing leak of cooling water through a gap of the rotating shaft. However, with such water pump, it is difficult to stop completely leak of cooling water via the mechanical seal. For this reason, there is known an arrangement in which the body of the pump is provided with a drain passage for discharging leaked cooling water to the outside of the pump. However, cooling water leaked from the drain passage forms water marks on the surfaces of the body and other component, which adversely affect the component or which can be erroneously determined as a defect of the water pump.

As a measure to cope with such inconvenience as above, in the case of a water pump of PTL 1, the body is provided with a discharge opening communicated to a space formed between the mechanical seal and the bearing and a reservoir communicated to the lower side of this discharge opening. With this arrangement, cooling water that has leaked from the mechanical seal can be reserved in the reservoir, thus preventing leakage of cooling water to the outside of the body.

Further, in the case of a water pump of PTL 2, the body is provided with a drain hole for draining cooling water that has leaked into the seal chamber of the bearing and a water-absorbing member (a felt, etc.) is provided downstream the drain hole, so that cooling water leaking from the mechanical seal is reserved within the water-absorbing member.

CITATION LIST

Patent Literatures

PTL 1: Japanese Examined Utility Model Application Publication No. 6-23760

PTL 2: Japanese Unexamined Utility Model Application Publication No. 2-90399

SUMMARY OF INVENTION

With the water pump disclosed in PTL 1, the arrangement simply retains cooling water in the reservoir. Therefore, if an additional amount of cooling water leaking from the mechanical seal flows into the reservoir, the amount of cooling water in excess of the capacity of the reservoir will leak to the outside, so that even a normally operating pump can be erroneously judged as a defect.

Further, with the water pump disclosed in PTL 2, a portion downstream the drain hole in which portion the water-absorbing member is stored is a storage groove whose lateral side is opened. Therefore, if affected by gravity or vibration of a vehicle, cooling water reserved in the water-absorbing member can sometimes flow out therefrom. Further, the water-absorbing member formed of felt or the like has an effect of allowing cooling water to be diffused throughout the felt, thus increasing the total surface area of the cooling water. However, as a result of impregnation of the interior of the felt with the cooling water, efficient contact between the cooling water and the atmosphere is prevented. Therefore, the evaporation rate of cooling water reserved in the water-absorbing member is slow. For this reason, when the amount of cooling water leaking from the mechanical seal increases, the cooling water will exceed the water absorption capacity of the water-absorbing member, thus leaking to the outside.

The object of the present invention is to provide a water pump that minimizes defects in which cooling water flows externally.

According to a first characterizing feature of a water pump of the present invention, the water pump comprises a rotating shaft supported by a body via a bearing; an impeller that is disposed at one end of the rotating shaft; and a seal member that is disposed between the impeller and the bearing;

wherein a drain passage that sandwiches the seal member and communicates with a space formed on the opposite side of the impeller is formed in the body; a reservoir is formed downstream from the drain passage; a drain hole is disposed in a position above walls that form the reservoir; and a water-absorbing planar member is positioned in the reservoir.

With the above-described arrangement, cooling water that has leaked and flows over the seal member between the impeller and the bearing in the water pump will flow through the drain passage into the reservoir downstream from the drain passage. Here, since a water-absorbing planar member is disposed in the reservoir, the cooling water past the drain passage will spread along the surface of the planar member, whereby the surface area of cooling water will be extended to a degree equivalent to the surface area of the planar member, thus promoting evaporation of cooling water. Namely, it is possible to reduce the gathering rate of cooling water inside the reservoir and to prevent leak of cooling water to the outside. As a result, it is possible to restrict occurrence of inconvenience that leakage of cooling water from the reservoir leads to erroneous judgment of a non-defective water pump as a defective article.

According to a second characterizing feature of a water pump of the present invention, the planar member has a shape having a bent portion or a curved portion.

With the above arrangement, since the planar member has a shape having a bent portion or a curved portion, the surface area of the planar member is increased, so that evaporation of cooling water absorbed in the planar member can be promoted.

According to a third characterizing feature of a water pump of the present invention, the planar member is spaced apart from the drain hole.

By spacing the planar member inside the reservoir apart from the drain hole, it is possible to prevent the cooling water flowing through the planar member inside the reservoir from flowing directly into the drain hole.

According to a fourth characterizing feature of a water pump of the present invention, the water pump comprises a rotating shaft supported by a body via a bearing; an impeller that is disposed at one end of the rotating shaft; and a seal member that is disposed between the impeller and the bearing;

wherein a drain passage that sandwiches the seal member and communicates with a space formed on the opposite side of the impeller is formed in the body; a reservoir is formed downstream from the drain passage; a drain hole is disposed in a position above walls that form the reservoir; and a plurality of water-absorbing members having water absorbing property are disposed in the reservoir, with forming gaps therebetween that allow passage of cooling water.

With this arrangement, cooling water that has leaked past the seal member between the impeller and the bearing in the water pump will flow through the drain passage into the reservoir downstream the drain passage. Here, since a plurality of water-absorbing members having water absorbing property are disposed in the reservoir, with forming gaps therebetween that allow passage of cooling water, the cooling water past the drain passage will spread along the surfaces of the plurality of water-absorbing members, whereby the surface area of cooling water will be extended to a degree equivalent to the surface area of the plurality of water-absorbing members, thus promoting evaporation of cooling water. Namely, it is possible to reduce the gathering rate of cooling water inside the reservoir and to prevent leak of cooling water to the outside. As a result, it is possible to restrict occurrence of inconvenience that leakage of cooling water from the reservoir leads to erroneous judgment of a non-defective water pump as a defective article.

According to a fifth characterizing feature of a water pump of the present invention, the plurality of water-absorbing members are spaced apart from the drain hole.

By spacing the plurality of water-absorbing members inside the reservoir apart from the drain hole, it is possible to prevent the cooling water flowing through the plurality of water-absorbing members inside the reservoir from flowing directly into the drain hole.

DESCRIPTION OF EMBODIMENTS

Next, a water pump relating to the present invention will be described with reference to the drawings.

First Embodiment

A water pump 1 circulates cooling water through an unillustrated engine and an unillustrated radiator of a vehicle. The cooling water is heated by heat generated at the engine and discharges the heat at the radiator, thereby cooling the engine.

[General Construction of Water Pump]

Figure 1:
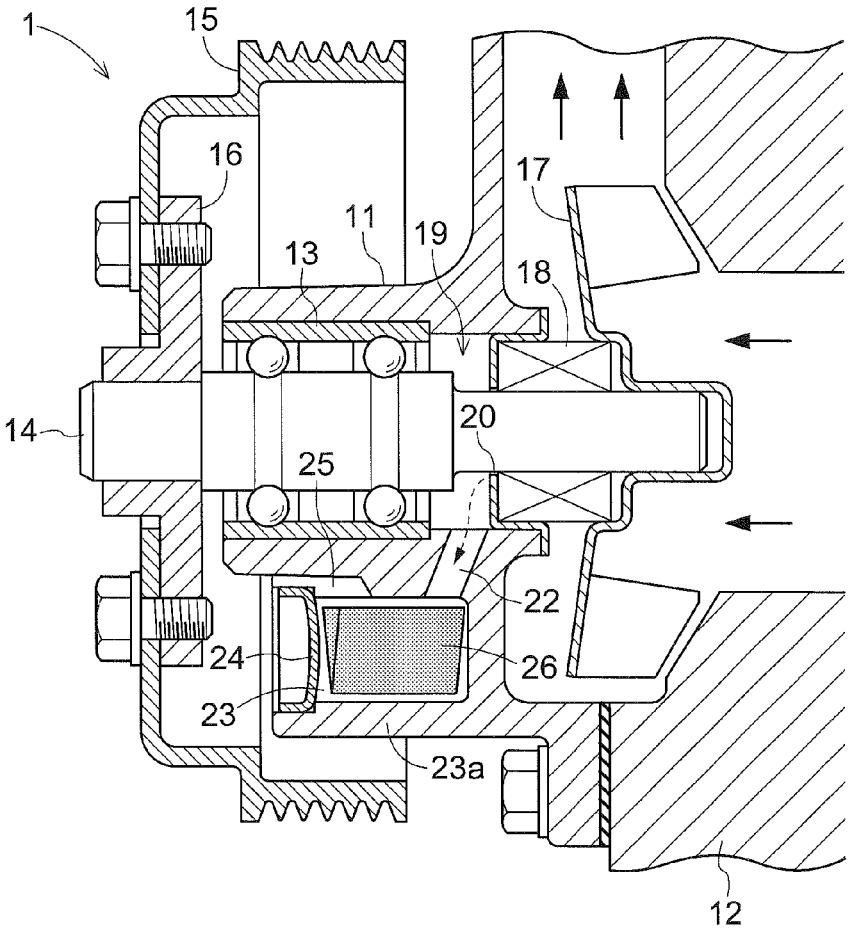
FIG. 1 is a vertical section showing an overall construction of a water pump according to a first embodiment.

The water pump 1, as shown in FIG. 1, has its body 11 fixed to a cylinder block 12 with a bolt. To the body, a rotating shaft 14 is supported via a bearing 13. At one end of the rotating shaft 14, an impeller 17 is provided and at the other end, a drive pulley 15 is fixed via a bracket 16. And, between the impeller 17 and the bearing 13, there is disposed a mechanical seal 18 as a seal member for preventing leak of cooling water via the gap of the rotating shaft 14.

In the body 11, there are formed a drain passage 22 communicated to a pace 19 (space 19 adjacent the mechanical seal 18) between the mechanical seal 18 and the bearing 13 and a reservoir 23 downstream from the drain passage 22. In FIG. 1, the drain passage 22 is formed with obliquely downward orientation. However, it will suffice for the drain passage 22 to be formed downwards, and the passage 22 need not be formed with inclination.

The reservoir 23 has an opening to be closed by a plug 24, on the lateral side opposite the impeller 17. At an upper position of a wall portion 23*a* that forms the reservoir 23, a drain hole 25 which communicates to the outside of the body 11 is formed. In this embodiment, the drain hole 25 is disposed at a position upwardly of the plug 24.

Figure 2:
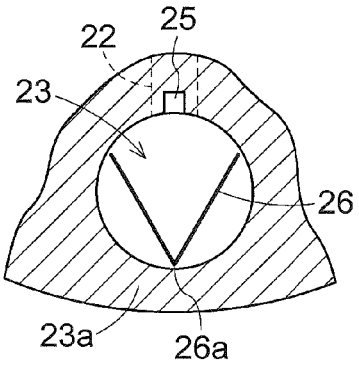
FIG. 2 is a front view in section showing vicinity of a reservoir.
Figure 3:
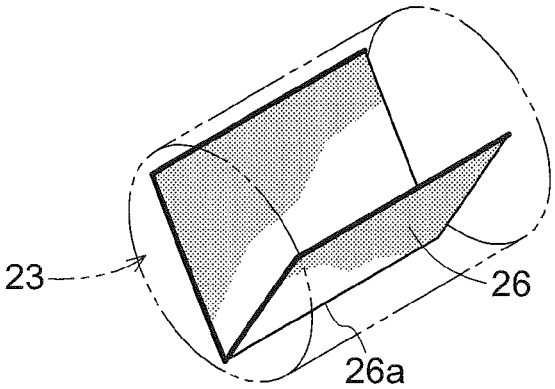
FIG. 3 is a perspective view of a planar member disposed within the reservoir.

As shown in FIGS. 1-3, inside the reservoir 23, there is provided a planar member 26 having water absorbing property, the planar member 26 being folded into halves and having a bent portion 26*a*. The planar member 26 is formed of e.g. a paper or the like having porosity. Preferably, the planar member 26 should not be deformed significantly even after impregnation with water. The planar member 26 can be disposed without being fixed inside the reservoir 23 or can be fixed to the inner face of the reservoir 23 by adhesion or the like.

When the rotating shaft 14 is driven by the drive pulley 15, the impeller 17 is rotated to introduce cooling water via a cooling water inlet and discharge the cooling water via a cooling water outlet. In the course of this, an amount of cooling water will leak via a small gap 20 between the mechanical seal 18 and the rotating shaft 14 into the space 19 between the mechanical seal 18 and the bearing 13 (the space 19 adjacent the mechanical seal 18). This cooling water will enter the inside of the drain passage 22 and be absorbed by the water-absorbent planar member 26 at the reservoir 23 and reserved or retained therein.

As the planar member 26 has a shape having the bent portion 26*a*, the surface area of the planar member 26 is increased, so that evaporation of cooling water absorbed in the planar member 26 can be promoted. Evaporated cooling water is discharged into the atmosphere via the drain hole 25. With this, it is possible to prevent leak of cooling water that flew into the reservoir 23 to the outside. As a result, it is possible to prevent leakage of cooling water of the reservoir 23 from leading to erroneous judgment thereof as a defect in the outer appearance of the water pump 1. Preferably, the planar member 26 should be disposed in such a manner as to extend throughout the inside of the reservoir 23 as much as possible. With this arrangement, it is possible to allow cooling water beginning to be accumulated in the reservoir 23 to be diffused fully in the inner space of the reservoir 23.

Further, the planar member 26 inside the reservoir 23 is disposed at a position spaced from the drain hole 25. By spacing the planar member 26 apart from the drain hole 25, it is possible to prevent the cooling water flowing through the planar member 26 inside the reservoir 23 from flowing directly into the drain hole 25.

Second Embodiment

Figure 4:
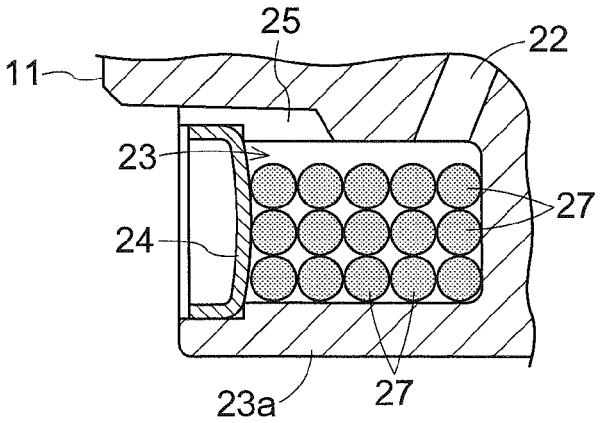
FIG. 4 is a vertical section showing vicinity of a reservoir in a second embodiment.

Instead of the planar member 26 according to the first embodiment, as shown in FIG. 4, in the reservoir 23, there can be provided a plurality of water-absorbing members 27 having water absorbing property. In this case, gaps will be provided between adjacent water-absorbing members 27, so as to allow introduction and flowing of cooling water into these gaps. This is advantageous for enhancing the water absorbing effect for cooling water. The water-absorbing members 27 are formed of porous member such as sponge, resin, etc. The shape of the water-absorbing member 27 can be not only a spherical shape (FIG. 4), but also a polygonal shape as long as it allows the formation of gaps between adjacent water-absorbing members 27. Further alternatively, in the reservoir 23, there can be provided a plurality of water-absorbing members 27 having different shapes or sizes in a mixed state.

Regarding the plurality of water-absorbing members 27 inside the reservoir 23 too, these members 27 are disposed at positions spaced from the drain hole 25, like the planar member 26 in the first embodiment. By disposing the plurality of water-absorbing members 27 spaced from the drain hole 25 as above, it is possible to prevent the cooling water flowing through the water-absorbing members 27 inside the reservoir 23 from flowing directly into the drain hole 25.

Other Embodiments (1) In the foregoing embodiments, the opening of the reservoir 23 is formed at the lateral portion thereof. Instead, the opening of the reservoir 23 may be formed at the bottom portion thereof to be sealed with the plug 24.

Figure 5:
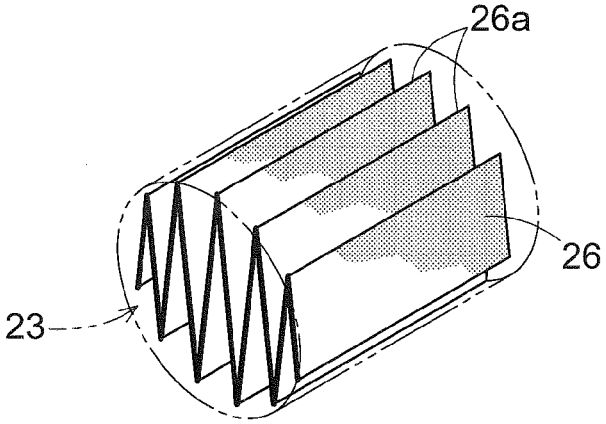
FIG. 5 is a perspective view of a planar member according to a further embodiment.

(2) In the foregoing embodiment, there was shown the arrangement of the planar member 26 being folded into halves. Instead, the planar member 26, as shown in FIG. 5, may be folded in the form of a zigzag pattern with many bent portions 26*a*. With presence of many bent portions 26*a* in the planar member 26, the rigidity of the member is increased correspondingly. Hence, it becomes possible to stabilize the shape of the planar member 26 inside the reservoir 23. Or, the planar member 26 may be provided in the form of sheet having no bent portion at all. In this, however, caution should be taken such that sufficient gap should be provided along the circumference of the sheet-like planar member 26 so as to facilitate evaporation of absorbed cooling water.

Figure 6:
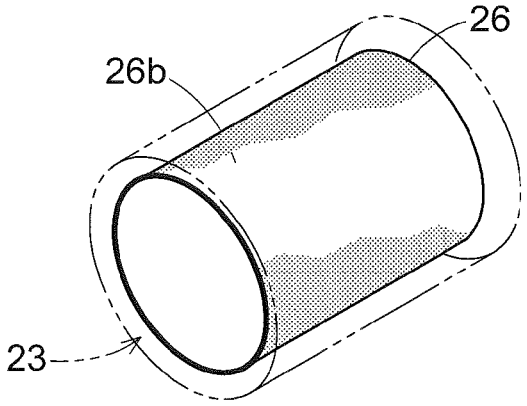
FIG. 6 is a perspective view of a planar member according to a further embodiment.
Figure 7:
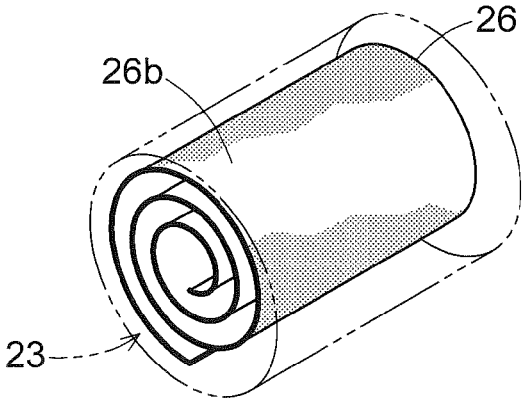
FIG. 7 is a perspective view of a planar member according to a further embodiment.
Figure 8:
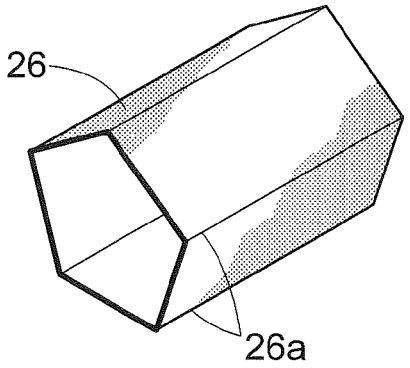
FIG. 8 is a perspective view of a planar member according to a further embodiment.
Figure 9:
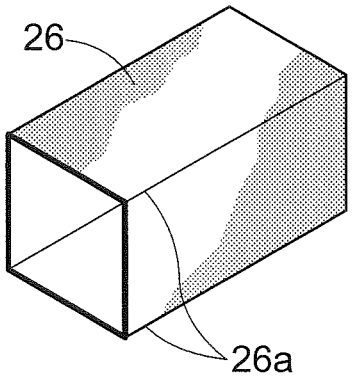
FIG. 9 is a perspective view of a planar member according to a further embodiment.
Figure 10:
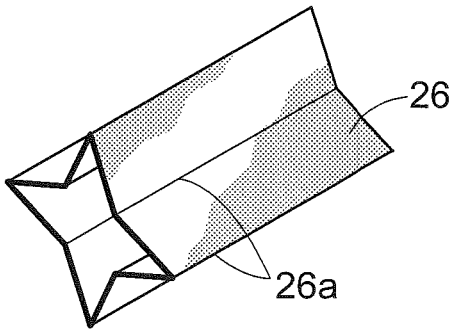
FIG. 10 is a perspective view of a planar member according to a further embodiment.

(3) The planar member 26 can be provided in the form of a cylinder (FIG. 6) having a curved portion 26*b* or in the form of a coiled roll (FIG. 7). Further alternatively, the planar member 26 can be provided in the form of a tube having a polygonal cross sectional shape. FIG. 8 shows such tubular planar member 26 having a pentagonal cross section, FIG. 9 shows one having a quadrilateral shape, and FIG. 10 shows a tubular planar member 26 having a star-shaped cross section, respectively. As the planar member 26 is to cause absorbed cooling water to evaporate positively, the greater its surface area, the better. Therefore, not being limited to the above arrangements wherein the overall shape of the planar member 26 is varied in many ways, the surface area can be increased also by providing the surface of the planar member 26 with an embossing work or the like.

(4) In the foregoing embodiments, there was shown an exemplary arrangement in which the planar member 26 is disposed with a horizontal orientation relative to the inside of the reservoir 23 (the planar member 26 is laid horizontally). Instead, the planar member 26 may be disposed with a vertical orientation relative to the inside of the reservoir 23 (the planar member 26 is disposed erect).

(5) The planar member 26 and the plurality of water-absorbing members 27 disposed in the reservoir 23 may be configured to be exchangeable through the opening of the reservoir 23. With this exchangeable arrangement of the planar member 26 and the plurality of water-absorbing members 27, the planar member 26 and the plurality of water-absorbing members 27 can be readily exchanged with one or ones having a shape or material suitable for the reservoir 23 of the water pump 1.

(6) In the foregoing embodiment, there was shown an example wherein the drain hole 25 is formed in the body 11. Instead, it is possible to employ a plug 24 defining a hole, such that the hole of this plug 24 after its attachment to the opening may be used as the drain hole 25.

INDUSTRIAL APPLICABILITY

A water pump relating to the present invention may be used as a water pump sued for a wide variety of objects to be cooled in various kinds of vehicle.

The invention claimed is:

1. A water pump comprising:

a rotating shaft supported by a body via a bearing;

an impeller that is disposed at one end of the rotating shaft; and a seal member that is disposed between the impeller and the bearing;

wherein a drain passage that sandwiches the seal member and communicates with a space formed on the opposite side of the impeller is formed in the body; a reservoir is formed downstream from the drain passage; a drain hole is formed at an upper position of a wall portion that forms the reservoir; a water-absorbing planar member is positioned in the reservoir; and a front surface and a rear surface of the planar member are exposed to air, wherein the planar member has a shape having a bent portion, and wherein the bent portion defines a recess which faces the drain passage.

2. The water pump according to claim 1, wherein the planar member is spaced apart from the drain hole.

3. The water pump according to claim 1, wherein the planar member has a V-shaped cross section and is oriented in the reservoir such that the bent portion is farthest away from the drain passage.

4. A water pump comprising:

a rotating shaft supported by a body via a bearing;

an impeller that is disposed at one end of the rotating shaft; and a seal member that is disposed between the impeller and the bearing;

wherein a drain passage that sandwiches the seal member and communicates with a space formed on the opposite side of the impeller is formed in the body; a reservoir is formed downstream from the drain passage; a drain hole is formed at an upper position of a wall portion that forms the reservoir; and a plurality of water-absorbing members having water absorbing property are disposed in the reservoir, with forming gaps therebetween that allow passage of cooling water, and wherein the plurality of water-absorbing members are spaced apart from the drain passage.

5. The water pump according to claim 4, wherein the plurality of water-absorbing members are spaced apart from the drain hole.

6. The water pump according to claim 4, wherein the plurality of water-absorbing members are spherical.

* * * * *